US005452528A

United States Patent [19]

Theurer et al.

[11] Patent Number: 5,452,528

[45] Date of Patent: Sep. 26, 1995

[54] BALLAST PLANING MACHINE

[75] Inventors: Josef Theurer, Vienna; Herbert Wörgötter, Gallneukirchen, both of Austria

[73] Assignee: Franz Plasser Bahnbaumaschinen-industrieges m.b.H., Vienna, Austria

[21] Appl. No.: 202,388

[22] Filed: Feb. 28, 1994

[30] Foreign Application Priority Data

Mar. 4, 1993 [AT] Austria ..... 421/93

[51] Int. Cl.[6] ..... F02F 5/22

[52] U.S. Cl. ..... 37/104; 171/16; 104/2

[58] Field of Search ..... 37/104, 105; 104/2, 104/279; 171/16; 414/528, 502, 503, 505, 523

[56] References Cited

U.S. PATENT DOCUMENTS

| | | | |
|---|---|---|---|
| 3,957,000 | 5/1976 | Plasser et al. | 37/104 X |
| 4,342,165 | 8/1982 | Theurer et al. | 37/104 |
| 4,706,395 | 11/1987 | Cicin-Sain | 171/16 X |
| 4,913,240 | 4/1990 | Mancini | 171/16 |
| 5,046,270 | 9/1991 | Theurer et al. | 37/104 |
| 5,084,989 | 2/1992 | Theurer et al. | 37/104 |
| 5,094,018 | 3/1992 | Theurer et al. | 37/104 |
| 5,101,733 | 4/1992 | Mohr | 171/16 X |

*Primary Examiner*—Dave W. Arola
*Assistant Examiner*—Robert Pezzuto
*Attorney, Agent, or Firm*—Henry M. Feiereisen

[57] ABSTRACT

A ballast planing machine includes a machine frame supported by undercarriages for movement in an operating direction along a track and comprised of a leading carrier frame which supports a vertically adjustable ballast plow arrangement and a further carrier frame which is linked to the leading carrier frame and supports an operator's cabin and a vertically adjustable, rotary sweeping broom. Mounted to the further carrier frame is also a negative pressure generator of a suction unit for removing excess ballast during movement of the machine frame in operating direction. The suction unit includes a suction tube which communicates with the negative pressure generator and extends in longitudinal direction beyond the machine frame to terminate in a suction nozzle which projects beyond the rearward end of the machine frame. The suction nozzle is operatively connected to a control unit which is installed in the operator's cabin and controls a movement of the suction nozzle between an idle non-operational position and an operational position.

12 Claims, 2 Drawing Sheets

BALLAST PLANING MACHINE

BACKGROUND OF THE INVENTION

The present invention refers to a ballast planing machine of the type having a machine frame supported by undercarriages for mobility along a track, with the machine frame supporting a vertically adjustable ballast plow arrangement, a vertically adjustable and rotatable sweeping broom, a suction unit including a vacuum or negative pressure generator as well as an operator's cabin.

European patent No. EP 0 418 428 A1 discloses a ballast planing machine of this type for shaping the ballast bed of a track, with the sweeping broom being arranged in a suction box which is in communication with a vacuum generator. During operation, dust swept up by the sweeping broom is immediately removed by suction before adversely affecting the environment.

German patent No. DE 21 36 306 A describes a mobile machine for excavating ballast from tracks, with a vehicle supporting a rotatable and swingable boom which carries a suction pipe. The suction pipe enters with one end a ballast storage container and extends beyond the operator's cabin to reach the ballast bed with its other end which is provided in form of a nozzle and acted upon by vibrators for loosening ballast being removed by suction.

Further suction pipes projecting beyond one end of the vehicle for withdrawing ballast are referred to in German patent no DE 91 11 238 U1, DE 90 00 529 U1 and European patent No. EP 0485 810 A1.

U.S. Pat. No. 5,052,132 discloses a ballast distributing and planing machine, with a machine frame including two hingedly connected carrier frames, with the leading carrier frame supporting the vertically adjustable ballast plow arrangement and a ballast storage container, and with the trailing carrier frame supporting the sweeping broom.

SUMMARY OF THE INVENTION

It is an object of the present invention to improve a ballast planing machine of the above-mentioned type in a manner enabling a desired shaping of the ballast bed also in those areas which are generally out of reach of the ballast plow arrangement and the sweeping broom.

This object and others which will become apparent hereinafter are attained in accordance with the present invention by providing a suction unit with a flexible suction tube which has one end connected to a vacuum or negative pressure generator and extending beyond the rearward end of the machine frame, with its other end terminating in a suction nozzle which faces the ballast bed and is adjustable by a control unit between an idle non-operational position and an operational position.

The provision of such a suction unit allows a shaping of the ballast bed during a single run also in those areas of the track which are essentially out of reach of the plow arrangement and sweeping broom to thereby achieve a very effective withdrawal of excess ballast and a proper ballast distribution. By projecting beyond the rearward end of the machine frame, the suction nozzle is clearly in viewing range from the cabin and can be rapidly positioned to reach all problem areas for removing by suction excess ballast or gathering dust without affecting the continuous advance of the ballast planing machine in operating direction.

Suitably, the machine frame includes two successively arranged and linked carrier frames, with the leading carrier frame supporting the ballast plow arrangement and the trailing carrier frame supporting the vacuum generator of the suction unit and the sweeping broom. The two-part configuration of the machine frame allows placement of the sweeping broom between the undercarriages without requiring rearwardly projecting parts overhanging the rear undercarriage, on the one hand, and placement of an operator's cabin on the rear end of the machine frame for precise viewing of the positioning of the suction nozzle, on the other hand.

Preferably, the trailing carrier frame supports in longitudinal direction of the elongated machine frame a conveyor belt which has a lower input end for receiving ballast and a higher discharge end for introducing ballast into a ballast storage container mounted to the leading carrier frame. In this manner, excess ballast drawn from the track may be stored by the machine for possible later use to fill track areas requiring additional ballast.

According to another feature of the present invention, the suction nozzle is shiftable from the operational position to a non-operational position in which the suction nozzle is positioned above and laterally next to the rear end of the machine frame, immediately behind the cabin. In this manner, the travel of the ballast planing machine e.g. during transfer for duty is not disturbed by the attachment of the suction nozzle. Suitably, the suction nozzle is mounted to a vertically adjustable parallel linkage which in turn is connected to a support member. A drive unit effectuates a tilting of the parallel linkage about a vertical axis and a displacement of the support member perpendicular to the longitudinal axis of the machine frame and horizontal in transverse direction to the longitudinal axis of the machine frame so that the suction nozzle is positionally adjustable over a wide range relative to the machine frame to permit a removal of ballast accumulations irrespective of their location, e.g. in the area of the track conductor.

In accordance with yet another feature of the present invention, the suction nozzle is connected via the suction tube to a cyclone for separating withdrawn ballast from the air flow, with the ballast being transportable to the storage container for possible later use to fill track areas requiring additional ballast. Suitably, the withdrawn flow of air and ballast is conducted through a fine dust filter to filter out dust which can be easily disposed of without harm to the environment when the planing machine is idle.

Preferably, the ballast plow arrangement is mounted on the machine frame between a forward cabin and the ballast storage container so as to give the operator an unobstructed view of the plow arrangement and to allow an optimal control of the plow arrangement during operation.

In accordance with still another feature of the present invention, the machine frame supports a second vertically adjustable sweeping broom, thus allowing the ballast planing machine to be equipped with sweeping brooms of different widths. Depending on prevailing conditions, the sweeping brooms can be rapidly interchanged to thereby permit a complete sweeping of e.g. a switch zone or crossover zone across the entire width.

According to another embodiment of the present invention, a ballast planing machine includes a machine frame which has a central carrier frame interposed between and linked with the leading and trailing carrier frames. The central carrier frame supports a ballast reservoir which cooperates with a bottom conveyor for transporting ballast to the ballast storage container. A ballast planing machine of this type affords a broader application because relatively large amounts of ballast can be transported by the ballast planing machine in order to fill track areas which may require significantly higher amounts of ballast. For this purpose, ballast can easily be transported via the bottom conveyor to the storage container and its discharge chute.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
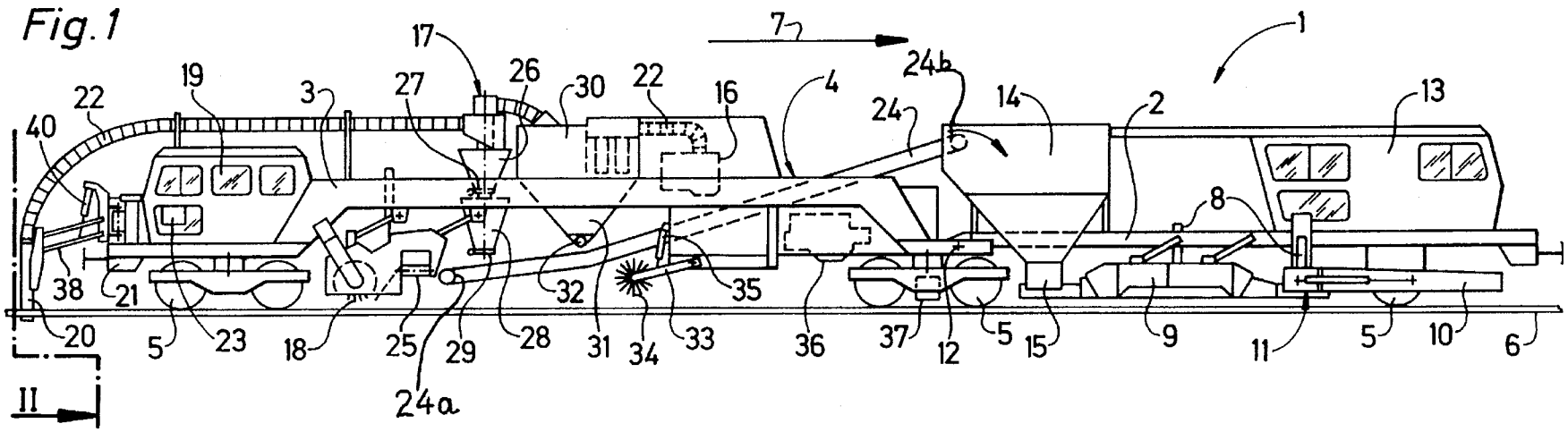
FIG. 1 is a side elevational view of one embodiment of a mobile ballast planing machine according to the present invention.

Throughout all the Figures, the same or corresponding elements are indicated by the same reference numerals.

Referring now to the drawing, and in particular to FIG. 1, there is shown a side elevational view of one embodiment of a mobile ballast planing machine according to the present invention, generally designated by reference numeral 1, for planing and shaping ballast in a track 6. The ballast planing machine 1 includes an elongated machine frame 4 which is supported on the track 6 by three undercarriages 5 for mobility along the track 6 in an operating direction, indicated by arrow 7. The machine frame 4 comprises two carrier frames 2, 3 which are arranged sequentially in operating direction, with carrier frame 2 forming the first or leading carrier frame and with the carrier frame 3 forming the second or trailing carrier frame. The carrier frames 2, 3 are linked in the area of the central undercarriage 5 by a coupling 12 to allow a relative adjustment of the carrier frames 2, 3 during travel of the machine 1.

An operator's cabin 13 is mounted on the front end of the carrier frame 2 which also supports a ballast plow arrangement, generally designated by reference numeral 11 and including a central ballast plow 9 and a pair of shoulder plows 10 (only one is shown in FIG. 1), with the shoulder plows 10 disposed laterally below the cabin 13 and the central plow 14 arranged immediately behind the cabin 13. In this manner, the ballast plow arrangement 11 is in clear viewing range of the operator.

At a distance from the cabin 13, the carrier frame 2 supports on its rearward end a ballast storage container 14 with a conical bottom from which a discharge chute 15 extends toward the track 6.

Mounted on the second trailing carrier frame 3 of the machine frame 4 is a suction unit, generally designated by reference numeral 17 for withdrawing excess ballast and dust particles from respective track or crib areas. The suction unit 17 includes a flexible suction tube 22 which is connected at one end to a vacuum or negative pressure generator 16. The suction tube 22 extends in longitudinal direction of the machine frame 4 beyond the rear machine end 21 and terminates at its other end in a suction nozzle 20 which points in direction of the track 6. Incorporated within the suction tube 22 between the suction nozzle 20 and the vacuum generator 16 is a cyclone 26 by which ballast is separated from the aspirated air stream. The cyclone 26 has a lower outlet opening 27 which opens into a lock-type receptacle 28. The lower end of the receptacle 28 has a remote-controlled discharge outlet 29 which is positioned directly above the conveyor belt 24 near the inlet end **24*a* so that ballast is transportable to the ballast storage container 14. The suction air stream exiting the cyclone 26 is conducted by the suction tube 22 through a fine dust filter unit, indicated at 30, by which filtered out dust is collected in a V-shaped container 31 and optionally unloaded to a screw conveyor 32 located at the lower end of the container 31**.

A further operator's cabin 19 is mounted on the rear end of the carrier frame 3 above the rear undercarriage 5. At a distance from the cabin 19, the carrier frame 3 supports a rotary sweeping broom 18 which extends transversely across the track 6 and is vertically adjustably mounted on the carrier frame 3. The broom 18 has radially extending flexible sweeping elements and is part of a ballast sweeping arrangement which includes a drive for rotating the broom 18 and a cross belt 25 for a allowing a lateral delivery of ballast onto the track 6. For ease of illustration, the drive and other necessary elements of the ballast sweeping arrangement have not been shown in detail as they do no form part of the present invention.

At operation of the machine 1, the broom 18 rotates to sweep up ballast from the track 6. Swept-up ballast is then discharged onto the input end **24*a* of the ascending conveyor belt 24 by which the ballast is transported to the output end 24*b* for introduction into the ballast storage container. The conveyor belt 24 is mounted to the trailing carrier frame 3 in inclined position, with the input end 24*a* extending at a lower level compared to the output end 24*b***.

Spaced from the rear broom 18 is an additional rotary sweeping broom 34 which is detachably secured to the second carrier frame 3 via a mounting 33 and is vertically adjustable for displacement to and from the track 6 by a drive 35. A motor 36 schematically indicated in FIG. 1 supplies power to all operating drives of the ballast planing machine 1, including the drive for advancing the ballast planing machine 1, along the track 6.

Figure 3:
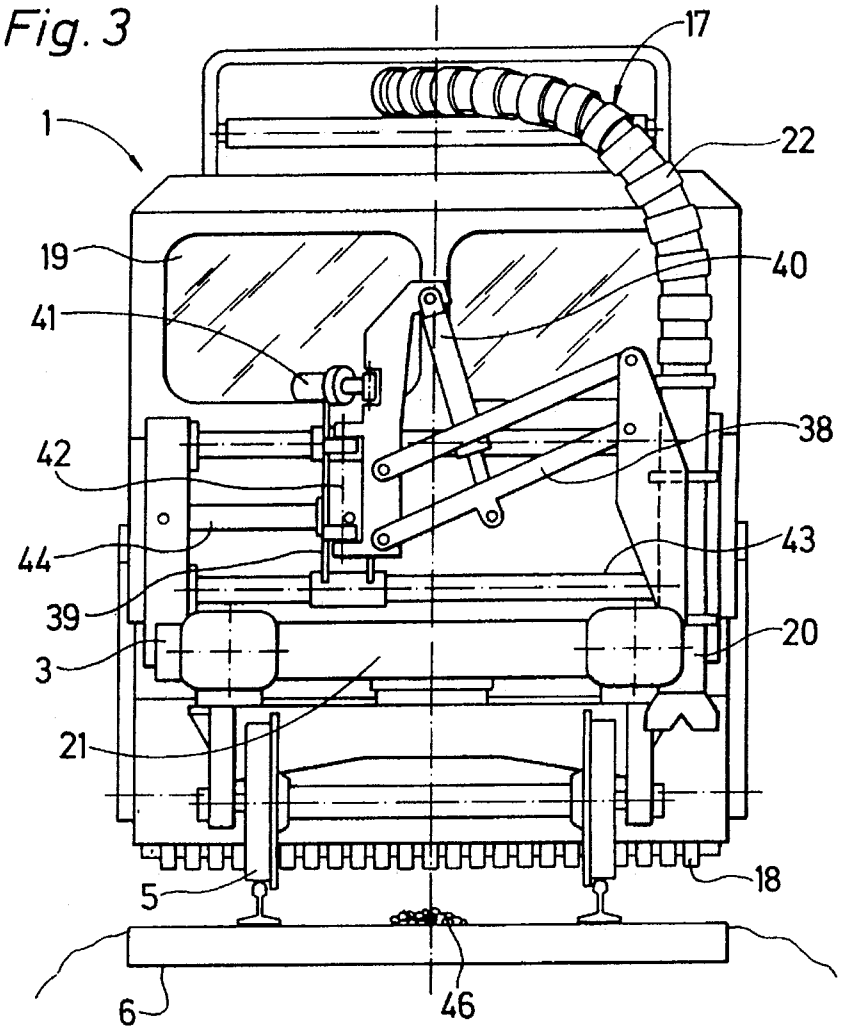
FIG. 3 is an end view of the ballast planing machine according to FIG. 2, with the suction nozzle in idle position.
Figure 2:
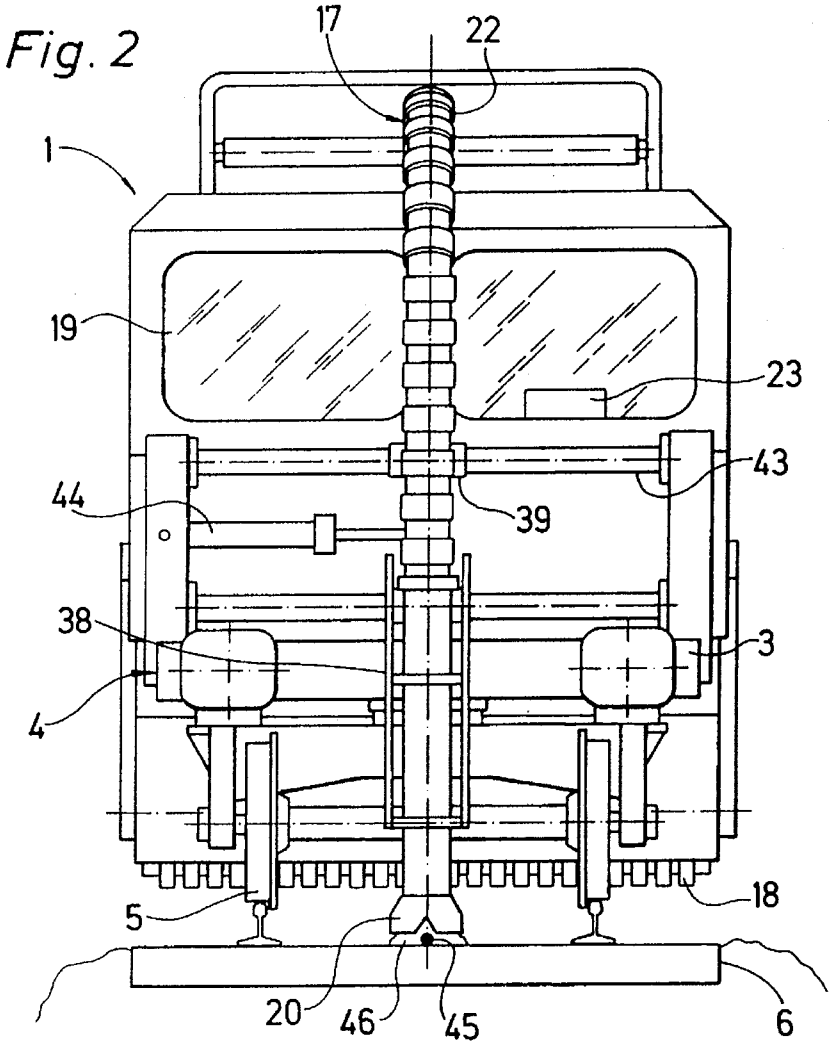
FIG. 2 is an end view of the ballast planing machine of FIG. 1 in direction of arrow II, showing in detail the suction nozzle in operational position.

Turning now to FIGS. 2 and 3, there are shown end views of the ballast planing machine of FIG. 1, with FIG. 2 illustrating in detail the suction nozzle 20 in operational position and with FIG. 3 illustrating the suction nozzle 20 in idle or non-operational position. The suction nozzle 20 is mounted on a parallel linkage 38 which is connected to a support member or mounting 39. A drive 40 acts upon the parallel linkage 38 to vertically adjust the linkage 38 together with the suction nozzle 20. A further drive 41 effectuates a tilting of the parallel linkage 38 toward the mounting 39 about a vertical axis 42. The mounting 39 is guided on parallel bars 43 by a drive 44 for horizontal displacement in a direction transversely to the longitudinal direction of the machine 1. The drives 40, 41, 44 are controlled by a control unit 23 which is installed in the cabin 19 for actuation by the operator.

In the operational position shown in FIG. 2, the suction nozzle 20 is lowered by the drive 40 to allow a continuous withdrawal of excess ballast accumulations 46 in the area of the track conductor 45. The suction nozzle 20 projects beyond the rearward end face of the carrier frame 3 of the machine frame 4 in such a manner that the operator in cabin 19 has an unobstructed view of the operational suction nozzle 20. Suitably, the length of both bars 43 for transverse displacement of the mounting 39 and thus of the suction nozzle 20 slightly exceeds the rail gage of the track 6 to enable the suction nozzle 20 for optionally removing ballast accumulations also in the crib end zone.

At operation, the central plow 9, both shoulder plows 10 and the rotary sweeping broom 18 are lowered to shape the ballast bed and to sweep up any plowed ballast as ballast planing machine 1 advances continuously along track 6 in direction of arrow 7. In track sections which lack ballast, additional ballast is supplied from storage container 14 onto the track 6. Ballast in the area of the track conductor 45 cannot be reached by the broom 18 and is removed by the suction nozzle 20 at the same time the plow arrangement 11 is operated. For this purpose, the suction nozzle 20 is suitably moved into the operational position as shown in FIG. 2 by the operator in the cabin 19 through actuation of the drives 40, 41, 44. In case additional ballast accumulations e.g. in the area of the track magnet are encountered besides the ballast accumulations 46, the position of the suction nozzle 20 is accordingly adjusted to remove also in those areas excess ballast. Removed ballast is then conducted through the cyclone 26 into the receptacle 28 and discharged via discharge outlet 29 onto the conveyor belt 24 for further transport to the ballast storage container 14.

FIG. 3 shows the suction nozzle 20 in its raised locked non-operational position. The suction nozzle 20 is lifted by the drives 40, 41, 44 and shifted laterally to a position above and laterally of the rearward machine end 21 immediately behind the cabin 19 within the structure gage so that the ballast planing machine 1 can be transferred for duty without obstructing the view of the operator in the cabin 19.

Figure 4:
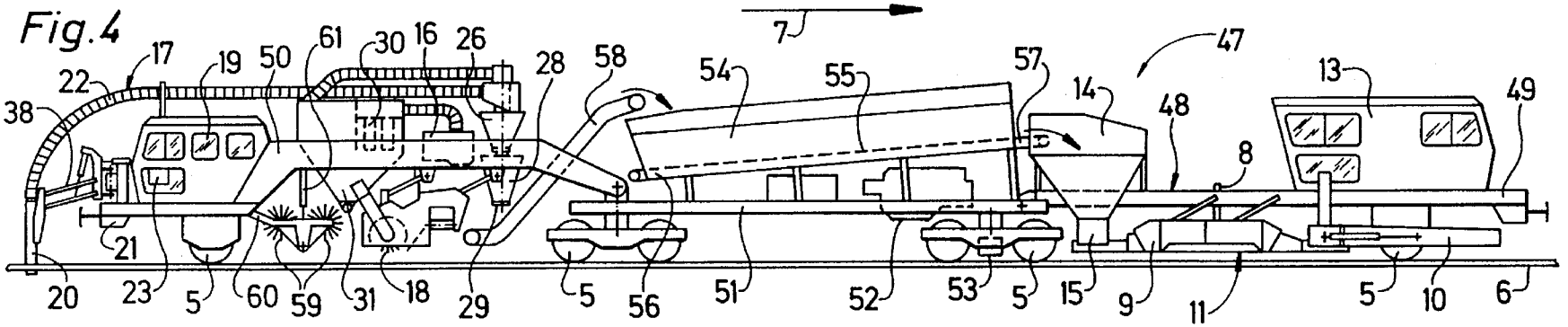
FIG. 4 is a side elevational view of another embodiment of a mobile ballast planing machine according to the present invention.

Turning now to FIG. 4, there is shown a side elevational view of another embodiment of a mobile ballast planing machine according to the present invention, generally designated by reference numeral 47. Same reference numerals have been used for designation of same parts in the embodiment of the ballast planning machine 1 as shown in FIG. 1.

The ballast planing machine 47 has a machine frame, generally designated by reference numeral 48 and comprising an additional central carrier frame 51 positioned between and hingedly connected to a first or leading carrier frame 49 and a second or trailing carrier frame 50. The central carrier frame 51 is supported by two bogies or undercarriages 5 and is designed in form of a self-propelling, motor-driven freight car, with a motor 52 supplying power to a drive 53 for advancing the central carrier frame 51 and thus the ballast planing machine 47 along the track 6. The leading and trailing carrier frames 49, 50 are each supported by only one undercarriage 5 and linked to the respective ends of the central carrier frame 51 in form of a trailer. Arranged on the carrier frame 51 is a ballast container 54 which has a bottom area in form of an ascending bottom conveyor 55 with lower input end 56 and higher discharge end 57.

The discharge end 57 is positioned above the ballast storage container 14 which is mounted on the leading carrier frame 49 while the rear input end 56 is positioned below the discharge end of a steep conveyor belt 58 which extends between the ballast container 54 and the sweeping broom 18 and transports to the ballast container 54 ballast removed from the track 6 as well as ballast exiting the lock-type receptacle 28 through discharge outlet 29.

At a location between the rearmost undercarriage 5 and the sweeping broom 18 are two further sweeping brooms 59 which are secured to the machine frame 48 via a mounting 60 and selectively lowered by a drive 61 toward the track 6 for exchange with the sweeping broom 18.

While the invention has been illustrated and described as embodied in a ballast planing machine, it is not intended to be limited to the details shown since various modifications and structural changes may be made without departing in any way from the spirit of the present invention.

What is desired to be protected by Letters Patent is set forth in the appended claims:

We claim:

1. A ballast planing machine, comprising:

a machine frame defining a longitudinal axis and supported by undercarriages for movement in an operating direction along a track and including a leading carrier frame and at least one further carrier frame linked to said leading carrier frame;

a cabin mounted on said further carrier frame for use by an operator;

a height-adjustable ballast plow arrangement mounted to said leading carrier frame;

a height-adjustable and rotatable sweeping broom mounted to said further carrier frame;

suction means for withdrawing excess ballast during movement of said machine frame in operating direction, said suction means including a negative pressure generator mounted on said further carrier frame of said machine frame, a suction tube having one end communicating with said negative pressure generator and another end terminating in a suction nozzle which projects beyond the rearward end of said machine frame; and control means received in said cabin for moving said suction nozzle between a non-operational position and an operational position.

2. The ballast planing machine of claim 1, and further comprising a ballast storage container supported by said leading carrier frame, and a conveyor belt mounted to said further carrier frame and extending in operating direction, said conveyor belt having a lower input end for receiving ballast from said sweeping broom and a higher discharge end for transporting ballast to said ballast storage container.

3. The ballast planing machine of claim 1 wherein said control means includes a drive unit for effectuating a movement of said suction nozzle between the non-operational position and the operational position, said suction nozzle being arranged in the non-operational position above and laterally next to the rearward end of said machine frame, immediately behind said cabin.

4. The ballast planing machine of claim 3, and further comprising mounting means for supporting said suction nozzle, said mounting including a vertically adjustable parallel linkage attached to said suction nozzle and a support member connected to said parallel linkage, said drive unit effectuating a tilting of said parallel linkage about a vertical axis and a displacement of said support member perpendicular to said longitudinal axis and horizontal in a direction transversely to the longitudinal axis of said machine frame.

5. The ballast planing machine of claim 1 wherein said suction means includes a cyclone incorporated in said suction tube and having a lower outlet opening, and further comprising a lock-type receptacle arranged in communication with said lower outlet opening of said cyclone and including a remote-controlled discharge outlet.

6. The ballast planing machine of claim 5, and further comprising a conveyor belt mounted to said further carrier frame and extending in operating direction, said conveyor belt having a lower input end for receiving ballast from said broom and a higher discharge end for transporting ballast to a storage container, said discharge outlet of said lock-type receptacle being arranged above said conveyor belt.

7. The ballast planing machine of claim 5 wherein said suction means includes a fine dust filter unit, said suction nozzle being connected to said fine dust filter unit via said suction tube.

8. The ballast planing machine of claim 7, and further comprising a container having a lower area provided with a screw conveyor, said fine dust filter unit being operatively connected with said container.

9. The ballast planing machine of claim 1, and further comprising a ballast storage container arranged on said leading carrier frame, and a second cabin supported by said leading carrier frame at a forward end thereof, said ballast plow arrangement being arranged immediately behind said second cabin between said second cabin and said ballast storage container so as to be in viewing range of a user.

10. The ballast planing machine of claim 1, and further comprising a second sweeping broom and a vertically adjustable mounting for detachably securing said second sweeping broom to said machine frame.

11. The ballast planing machine of claim 1 and further comprising a ballast storage container arranged on said leading carrier frame, said machine frame having a third central carrier frame arranged between and linked with said leading carrier frame and said further carrier frame, and further comprising a ballast container supported by said third carrier frame and having a bottom area in form of a bottom conveyor belt extending above said ballast storage container.

12. The ballast planing machine of claim 11 wherein said third carrier frame is designed in form of a self-propelled freight car with bogies and a drive unit, with said leading and further carrier frames being linked in form of a trailer.

* * * * *